US012698056B2

(12) United States Patent
Moxham et al.

(10) Patent No.: US 12,698,056 B2
(45) Date of Patent: Aug. 4, 2026

(54) MARINE VESSEL COMPRISING A PLANING HULL

(71) Applicants: John Moxham, Hampshire (GB); THE ULTIMATE BOAT COMPANY LIMITED, Douglas (GB)

(72) Inventors: John Moxham, Hampshire (GB); Colin Macandrew, Douglas (GB)

(73) Assignee: THE ULTIMATE BOAT COMPANY LIMITED, Douglas (IM)

( * ) Notice: Subject to any disclaimer, the term of this patent is extended or adjusted under 35 U.S.C. 154(b) by 400 days.

(21) Appl. No.: 18/546,164

(22) PCT Filed: Feb. 8, 2022

(86) PCT No.: PCT/EP2022/053001
§ 371 (c)(1),
(2) Date: Aug. 11, 2023

(87) PCT Pub. No.: WO2022/171619
PCT Pub. Date: Aug. 18, 2022

(65) Prior Publication Data

US 2024/0132180 A1 Apr. 25, 2024
US 2024/0227983 A9 Jul. 11, 2024

(30) Foreign Application Priority Data

Feb. 12, 2021 (EP) ..... 21156803

(51) Int. Cl.
*B63B 1/20* (2006.01)

(52) U.S. Cl.
CPC ..... *B63B 1/20* (2013.01)

(58) Field of Classification Search
CPC .... B63B 1/18; B63B 1/20; B63B 1/22; B63B 1/042; B63B 2001/201
See application file for complete search history.

(56) References Cited

U.S. PATENT DOCUMENTS 1,050,517 A * 1/1913 Chase ..... B63B 1/20 114/291
3,040,687 A 6/1962 Huet
(Continued)

FOREIGN PATENT DOCUMENTS

CN 101774419 A 7/2010
CN 106314676 A 1/2017
(Continued)

OTHER PUBLICATIONS

European Application No. 21156803.5 filed Feb. 12, 2021; Extended European Search Report dated Aug. 3, 2021; 10 pages.
(Continued)

*Primary Examiner* — Joshua E Freeman
(74) *Attorney, Agent, or Firm* — CANTOR COLBURN LLP

(57) ABSTRACT

The present disclosure is directed towards a marine vessel comprising a bow section, a stern section, a centreline and a planing hull. The planing hull comprises a vee bottom section extending along the centreline from the stern section to the bow section and a pair of retainer walls extending from the stern section towards the bow section along either side of the vee bottom section. Each retainer wall extends downwardly parallel to, or at an acute angle to, the centreline. The vee bottom section is configured to, in use, direct water outwardly from the centreline towards the retainer walls. The retainer walls are configured to downwardly direct said outwardly directed water for providing lift to the marine vessel.

21 Claims, 8 Drawing Sheets

(56) References Cited

U.S. PATENT DOCUMENTS 3,216,389 A * 11/1965 Thorsen ..... B63B 1/20 114/62
4,004,542 A 1/1977 Holmes
4,091,761 A * 5/1978 Fehn ..... B63B 1/042 114/271
4,233,920 A * 11/1980 Wood ..... B63B 1/18 114/291
4,409,922 A * 10/1983 Mambretti ..... B63B 1/20 114/283
4,520,746 A * 6/1985 Walters ..... B63B 43/14 114/69
4,584,959 A * 4/1986 Allison ..... B63B 1/04 114/291
4,672,905 A 6/1987 Pipkorn
4,708,085 A * 11/1987 Blee ..... B63B 1/18 114/291
4,722,294 A * 2/1988 Bruning ..... B63B 1/18 D12/310
4,774,902 A * 10/1988 Sinclair, Jr. ..... B63B 1/18 114/271
5,228,407 A * 7/1993 Cummer ..... B63B 7/082 441/40
5,282,436 A * 2/1994 Hansen ..... B63B 3/08 114/283
5,419,274 A 5/1995 van Diepen
5,476,061 A * 12/1995 Ackerbloom ..... B63B 1/04 114/291
5,685,253 A * 11/1997 Alexander, Jr. ..... B63B 1/18 114/291
5,934,218 A * 8/1999 Chen ..... B63B 1/042 114/288
6,223,677 B1 * 5/2001 Hall ..... B63B 3/08 114/364
6,425,341 B1 7/2002 Devin
6,666,160 B1 * 12/2003 Orneblad ..... B63B 1/20 114/291
6,871,612 B2 3/2005 Gursoy
8,291,850 B1 * 10/2012 Peters ..... B63B 1/38 114/289
12,037,083 B1 * 7/2024 McDonald ..... B63B 1/08
2002/0096101 A1 * 7/2002 Hansen ..... B63B 7/082 114/345
2004/0134407 A1 * 7/2004 Gursoy ..... B63B 73/43 114/356
2008/0011215 A1 * 1/2008 Hansen ..... B63B 1/16 114/283
2010/0313808 A1 12/2010 Hansen
2015/0114278 A1 * 4/2015 Torres ..... B63B 1/38 114/291
2015/0329179 A1 * 11/2015 Hotary ..... B63B 1/042 114/290
2016/0129970 A1 * 5/2016 Bjersten ..... B63B 1/042 114/271
2017/0029075 A1 * 2/2017 Rickborn ..... B63B 5/24
2019/0176934 A1 * 6/2019 Matthews ..... B63B 1/10

FOREIGN PATENT DOCUMENTS

CN 206561926 U 10/2017
DE 102020101671 A1 8/2020
EP 0033563 A1 8/1981
JP 2017114141 A 6/2017
JP 6554032 B2 7/2019

OTHER PUBLICATIONS

International Preliminary Report on Patentability for International Application No. PCT/EP2022/053001; International Filing Date: Feb. 8, 2022; Date of Mailing: May 16, 2023; 14 pages.
International Search Report for International Application No. PCT/EP2022/053001; International Filing Date: Feb. 8, 2022; Date of Mailing: May 17, 2022; 3 pages.
Written Opinion for International Application No. PCT/EP2022/053001; International Filing Date: Feb. 8, 2022; Date of Mailing: May 17, 2022; 6 pages.
CN Office Action with English Translation; Application No. 202280014410.4; Mailing Date: Jan. 22, 2024; pp. 1-14.
New Zealand Office Action, Application No. 803582, mailed May 26, 2025, 6 pages.

* cited by examiner

MARINE VESSEL COMPRISING A PLANING HULL

CROSS REFERENCE TO RELATED APPLICATIONS

This application is a National Stage application of PCT/EP2022/053001, filed Feb. 8, 2022, which claims the benefit of European Application No. 21156803.5, filed Feb. 12, 2021, both of which are incorporated by reference in their entirety herein.

TECHNICAL FIELD

This disclosure is directed towards a marine vessel comprising a planing hull and a method of operating such a marine vessel.

BACKGROUND

It is common for marine vessel hulls to be designed to promote planing at high speeds. When such a marine vessel operates at low speed its weight is supported by the buoyancy force exerted by the water and the hull operates as a displacement hull. At higher speeds, however, the hull is designed such that the weight of the marine vessel is predominantly supported by hydrodynamic lift. In order to promote planing such hulls are typically designed with a relatively flat bottomed aft section to provide a surface with an angle of attack that increases the hydrodynamic lift. In addition, the marine vessel is designed with a high power to weight ratio to assist with bringing the vessel on plane. However, marine vessels with flat bottomed hulls are relatively unstable in the water and usually have large turning radiuses at high speeds.

US2015/0329179A1 discloses a hybrid hull form for monohull planing vessels with combined features of catamaran hulls and convention V-shaped hulls. The hull comprises a non-stepped V-shaped centre section extending along the entire length of the hull and two semi-sponsons comprising projections extending away from the centre-section and disposed along the length of said hull form on either side of the centre section. The centre section and semi-sponsons each define a running surface for the hull. The semi-sponsons provide buoyancy and hydrodynamic lift. However, such a hull shape is prone to slamming at planing speeds through the waves.

SUMMARY

An object of the present disclosure it to provide a marine vessel with an improved planing hull. A further object is to provide a marine vessel with a planing hull with improved stability. A further object is to provide a marine vessel with improved maneuverability, particularly during turns. A further object is to provide a marine vessel with reduced spray rising over the hull and into the cockpit.

The present disclosure therefore provides a marine vessel and a method of operating such a marine vessel in accordance with the claims.

When a standard vee hulled planing vessel moves at speed through water, water of the bow wave hits the bottom of the hull at an angle (the angle of attack), which causes a lifting force with equal and opposite reaction in the hull such that the vessel is lifted upwards over the bow wave and begins to plane. The angle of attack however has unwanted consequences as the bow tends to be thrown upwards as it rides the waves, providing an uncomfortable ride. The lack of hull surface in the water produces directional instability and poor grip during fast turns. The water is parted by the vee hull and moves upward towards the outer edge or chine of the hull. The water is then thrown away from the boat in the form of wash.

However, the marine vessel of the present disclosure is configured to produce lift without a high angle of attack by providing hydraulic lift to bring the vessel onto the plane and to maintain it on the plane. The marine vessel is not dependent upon a bow wave to provide the force to lift the bow onto the plane as in standard vessels; instead the marine vessel is effectively lifted at the stern onto the plane by virtue of the retaining walls. The lift at the stern results in a lower angle of attack relative to other planing vessels and numerous other benefits.

In particular, the wash normally thrown to each side by the vee bottom section hits the retaining walls. The retaining walls substantially keep or retain that wash between them and the vee bottom section and water droplets from the wash join a larger substantially incompressible mass of water between the retaining walls. As the marine vessel passes over the mass, this mass moves rearwardly or aft relative to the marine vessel. This relatively higher mass of water lifts the stern section upwards, brings the marine vessel onto the plane and maintains the marine vessel on the plane.

Thus, the retainer walls may be configured to, as the marine vessel travels over the water, direct said outwardly directed water rearwardly relative to the hull and retain said outwardly directed water between the retainer walls and vee bottom section in at least the stern section. The retainer walls may be configured to, substantially continuously towards the hull stern, increase the ratio of water to air per unit of the volume between the retainer walls and the vee bottom section. The retainer walls may therefore increase the mass of water in the volume between the retainer walls and the vee bottom section as compared to the mass of water in such a volume if the retainer walls did not stop outward movement of the outwardly directed water.

In particular, the vee bottom section is configured to, during use and/or when the marine vessel is propelled through water, direct water outwardly from the centreline towards the retainer walls. The retainer walls may be configured to substantially stop or retain the outward movement of the outwardly directed water (i.e. that directed onto the retainer walls from the vee bottom section) and may redirect the outwardly directed water to move relatively parallel to the direction of travel of the marine vessel, the centreline and/or the keel.

The retainer walls may be configured to direct said outwardly directed water aft and/or downwardly for providing hydrodynamic or hydraulic lift to the marine vessel. The retainer walls prevent most of this wash from escaping outboard to the chine and as water cannot move downwardly and is incompressible, it lifts the hull upwards. Hence whilst the retainer walls may direct the outwardly directed water downwardly, such water may not be able to move downwardly and is instead directed aft towards the hull stern.

As a result, the marine vessel is much flatter (fore and aft) and level during propulsion and operates on the plane at a smaller angle of attack to the water surface than a standard vee hulled planing vessel. This has a number of significant benefits. The marine vessel rides in a more stable and aerodynamic position, thereby improving the comfort of the crew and reducing the energy consumed for the propulsion. The crew will also be able to see significantly more over the bow of the vessel because it is lower; this can be very beneficial in applications such as during rescues or the like.

Furthermore, particularly when the retainer walls extend from the hull stern (i.e. terminate at the hull stern to create a stepped stern profile), the water exiting the rear of the hull and hitting the propellers is much cleaner and has significantly fewer bubbles (i.e. reduced cavitation). This is due to the retainer walls effectively compressing the water droplets of the wash from the vee bottom section into a mass of water. Propellers at the hull stern therefore receive cleaner, less cavitated water, meaning that there is less propeller slip. The marine vessel can therefore operate at greater acceleration and torque. In turns, the reduction in propeller slip means that the propeller has greater traction or "grip" in the water, meaning that the marine vessel can turn with significantly less sideways movement through the water.

In addition, the marine vessel is much better suited to carrying higher loads. When a normal vee hulled boat is loaded its stern sinks and its bow will naturally lift. A normal vee hulled boat also has to ride over a relatively large bow wave in order to plane, which can be difficult or impossible if the boat is heavily loaded. However, as the retainer walls of the present disclosure provide lift along the length of the underside of the marine vessel and the lift is not just focused on the stern (although the lift force gradually decreases towards the bow as the retainer walls reduce in height), the vessel rides flatter and more level even when loaded. Thus the marine vessel can carry relatively heavier loads. By virtue of the lift maintaining the level and flat ride, the location of a high load within the vessel does matter as significantly as in a normal vee hulled boat. Furthermore, as the vessel rides flatter, the bow wave is smaller when getting onto the plane, meaning that high loads do not pose as significant an issue in order for the vessel to begin to plane.

A significant benefit of the ability of the marine vessel to carry heavier loads is that the power unit supplying the propulsive force can be heavier and, as a result, power units operated based upon renewal energy can be used. For example, the power unit may receive power from hydrogen sources, batteries or the like, all of which cause significant issue in normal vee hulled boats due to their weight. As a result, fossil fuel use can be reduced by the marine vessel.

In addition the marine vessel is very stable and maneuverable due to the grip the retainer walls have on the water during turns. In addition to the benefits of reduced cavitation at the propellers, the external retainer wall in a turn will pop out of the water whilst the internal retainer wall will remain in the water, providing an equal and opposite force against sideways movement in the water. In effect, the retainer walls substantially reduce the amount the marine vessel slides in the water during sharp turns and thus the marine vessel can turn in a tight circle.

The vee bottom section and retainer walls may therefore be shaped and sized to increase the resulting hydraulic lift, for example by surface area of the vee bottom section being significantly larger than that of the retainer walls (for example being at least twice the size or at least four times the size). In particular, a keel of the marine vessel may be formed by the vee bottom section and the keel is lower than the retainer walls. The vee bottom section may comprise a pair of lower main sections each extending outwardly from each side of the centreline along a lower main section width A. The retainer walls may extend along a retainer wall height B and the retainer wall height B may be less than about 0.5 A in the stern section and/or an amidships section.

The vee bottom section may be sufficiently steeply angled to push water outwards towards the retainer walls and may extend outwardly from the centreline at a vee bottom angle $\alpha$ relative to horizontal, which may be in the range of from about 18 degrees to about 28 degrees inclusive in the stern section and/or an amidships section. The retainer wall may be sufficiently steeply angled to stop or prevent further outward movement of the water and/or push water downwardly and may extend downwardly at a retainer wall angle $\beta$ relative to horizontal, which may be in the range of from about 70 degrees to about 90 degrees inclusive in the stern section and/or amidships section. The angle between the vee bottom section and retainer walls may be in the range of from about 50 degrees or about 60 degrees to about 90 degrees inclusive or about 100 degrees inclusive and may be less than 90 degrees in the stern section and/or amidships section. The vee bottom section and/or retainer walls may comprise flat planar surfaces in the stern section and/or amidships section.

The retainer walls may be configured to control the amount of lift provided and the centre of lift can be altered fore and aft by discontinuing the retainer rails before they reach the hull stern. In particular, the retainer walls may not extend from and are separated from the hull stern. The vee bottom section may extend between the hull stern and the retainer walls. By not having retainer walls directly at the hull stern pressure can escape, thereby reducing the lift provided as no hydraulic lift is provided at the hull stern.

However, as the marine vessel of the present disclosure rides flatter than standard vee hulled planing vessel, the hull cuts through the waves and throws water spray up in a direction over the top of the bow section. Therefore, the bow section may comprise at least one spray deflector for deflecting spray from rising over the bow section, the at least one spray deflector comprising a deflection surface extending downwardly forwards along the centreline and outwards from the centreline. The spray deflector is arranged to deflect such spray downwardly and thus reduce the volume of spray reaching the deck of the marine vessel.

The marine vessel of the present disclosure comprises a bow section, a stern section, a centreline and a planing hull. The planing hull comprises a vee bottom section extending along the centreline from the stern section to the bow section and a pair of retainer walls extending from the stern section towards the bow section along either side of the vee bottom section. Each retainer wall extends downwardly parallel to, or at an acute angle to, the centreline.

The present disclosure provides a marine vessel comprising: a bow section, a stern section and a centreline; and a planing hull comprising: a vee bottom section extending along the centreline from the stern section to the bow section; and a pair of retainer walls extending from the stern section towards the bow section along either side of the vee bottom section, wherein each retainer wall extends downwardly parallel to, or at an acute angle to, the centreline, wherein the vee bottom section is configured to, in use, direct water outwardly from the centreline towards the retainer walls and the retainer walls are configured to (a) downwardly direct said outwardly directed water and optionally preventing most of this wash from escaping outboard to an outer edge of the hull and/or (b) direct said outwardly directed water rearwardly relative to the hull and retain said outwardly directed water between the retainer walls and vee bottom section in at least the stern section, for providing lift to the marine vessel.

The method of the present disclosure comprises propelling such a marine vessel through water such that the vee bottom section directs water outwardly from the centreline towards the retainer walls and the retainer walls downwardly direct said outwardly directed water such that lift is provided to the marine vessel by the downwardly directed water. Thus the marine vessel may be brought onto and/or maintained on the plane during propulsion.

In the present disclosure the term "centreline" refers to a vertical plane passing down the centre of the marine vessel from the vessel bow to the vessel stern and thus is the dividing plane between port and starboard sides of the marine vessel. The hull may be substantially symmetrical about the centreline.

In the present disclosure the term "forwards" refers to a direction from the stern through the bow of the marine vessel (i.e. the opposite of aft). In the present disclosure the terms "downwards" or "downwardly" refer to a direction towards the line of a keel of the marine vessel, at an acute angle to the direction of gravity and/or towards and into the water in which the marine vessel floats, preferably when the marine vessel is in a neutral, unladen and stopped position in the water. In the present disclosure the term "upwardly" refers to the opposite direction to downwardly. "Upper" and "lower" refer to upwards and downward positions respectively.

In the present disclosure the term "horizontal" means along or parallel to the orthogonal of the plane of the centreline. It will be appreciated that the horizontal may not necessarily be perpendicular to the direction of gravity as the marine vessel rocks and moves in water. In the present disclosure the term "outwardly" means in a horizontal direction away from the centreline towards the port or starboard sides of the marine vessel (i.e. laterally).

BRIEF DESCRIPTION OF THE DRAWINGS

By way of example only, embodiments of marine vessels of the present disclosure are now described with reference to, and as shown in, the accompanying drawings, in which.

DETAILED DESCRIPTION

Figure 1:
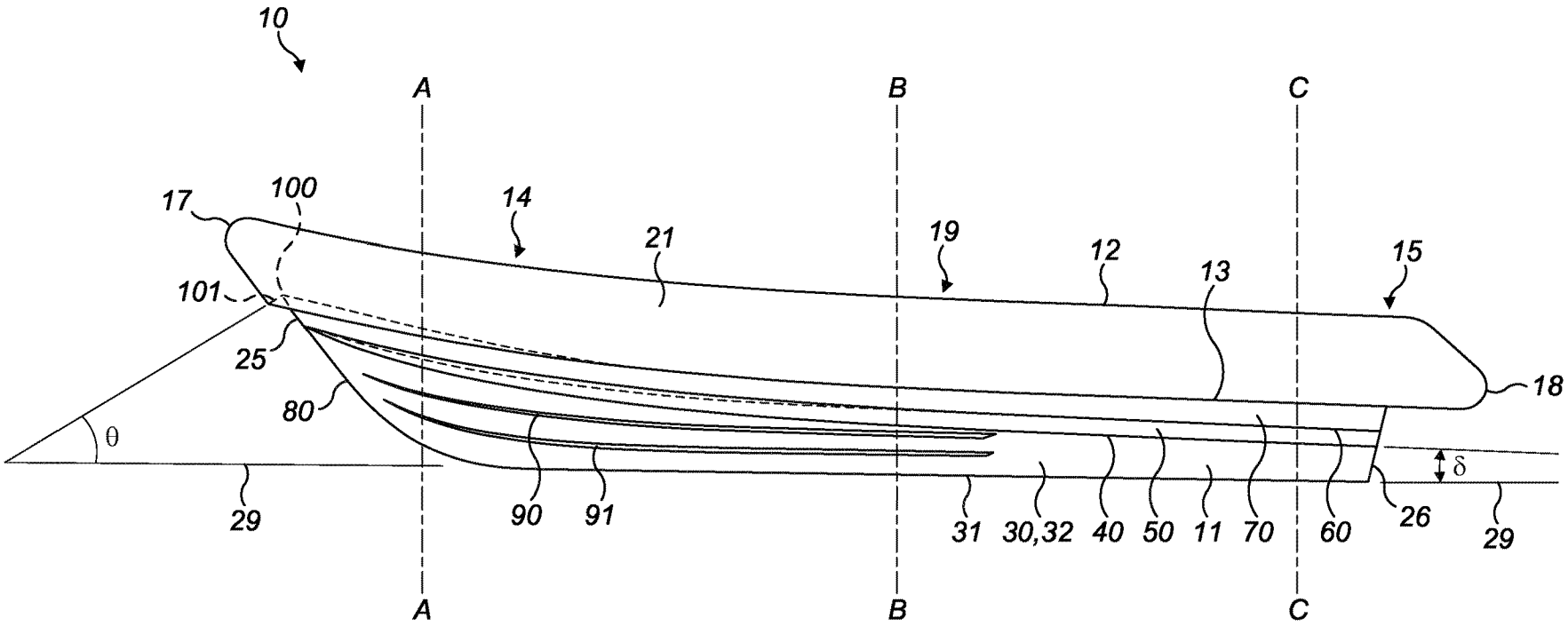
FIG. 1 is a schematic side elevation of the port side of a marine vessel comprising a hull in accordance with the present disclosure.
Figure 2A:
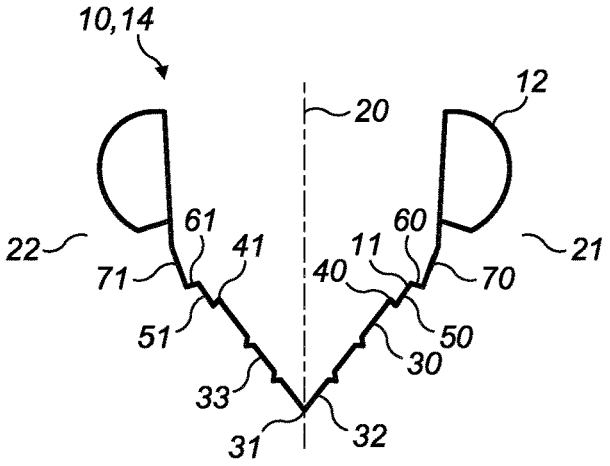
FIG. 2A is a cross-sectional view through section A-A of FIG. 1.
Figure 2B:
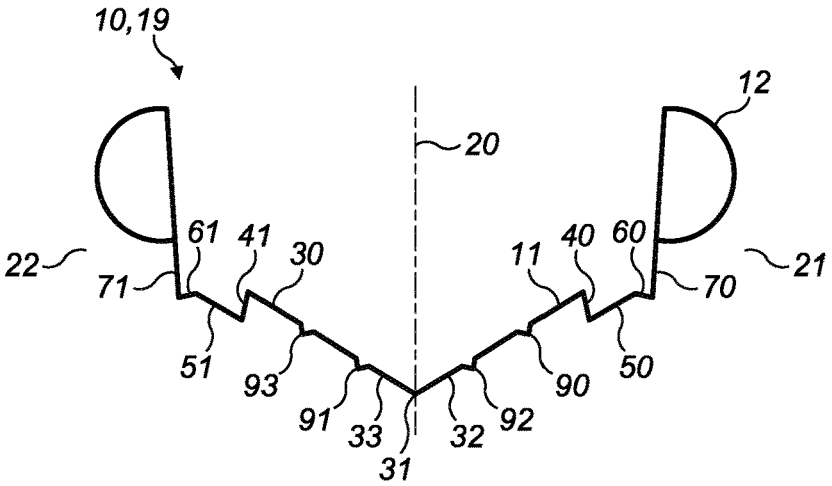
FIG. 2B is a cross-sectional view through section B-B of FIG. 1.
Figure 2C:
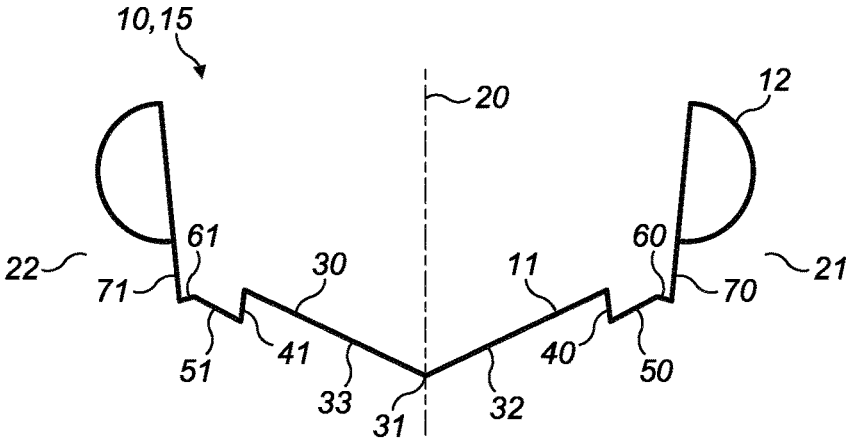
FIG. 2C is a cross-sectional view through section C-C of FIG. 1.

As illustrated in the Figures, the present disclosure provides a marine vessel 10 comprising a planing hull 11. In the present disclosure the term "planing hull" means that the hull 11 is designed such that at high speeds the weight of the marine vessel 10 is predominantly supported by hydrodynamic lift.

The marine vessel 10 of the present disclosure may be a powerboat and may be a rigid inflatable boat (RIB) as illustrated. Other suitable powerboats include recreational powerboats, cruisers, high performance powerboats, jet powerboats, jet skis and the like. For example, the marine vessel 10 may be less than 20 m long or less than 15 m long.

Although not illustrated in the Figures, in use the marine vessel is propelled through the water and the powerboat may comprise at least one power unit attached to at least one propulsor, such as a propeller or jet, to drive the powerboat through water. The at least one power unit may be a mechanical power unit, such as an internal combustion engine, or may be an electric power unit, such as a motor receiving energy from an electrical power source.

The marine vessel 10 comprises a bow section 14, a stern section 15 and a centreline 20 extending therebetween. The bow section 14 extends from a vessel bow 17 (i.e. the forward most part) of the marine vessel 10 and may extend along up to 25% of the length of the marine vessel 10. The stern section 15 extends from a vessel stern 18 (i.e. the rearmost part) of the marine vessel 10 and may extend along up to 25% of the length of the marine vessel 10. The marine vessel 10 may comprise an amidships section 19 extending between the bow and stern sections 14, 15. The marine vessel 10 may comprise port and starboard sides 21, 22 on either side of the centreline 20.

The marine vessel 10 may comprise an upper body 12 mounted to the hull 11. The upper body 12 may be mounted to an upper edge 13 of the hull 11 and may extend around the bow section 14 and port and starboard sides 21, 22 of the hull 11. The upper body 12 may form the vessel bow and/or stern 17, 18 of the marine vessel 10 and may at least partially form the bow and/or stern section 14, 15.

The upper body 12 may comprise a fender, such as in the case of the RIB illustrated in FIG. 1. The fender may be flotation device such as an inflatable or foam fender. In the latter case, the marine vessel 10 may still be considered a RIB by virtue of the foam fender being considered a flotation device as required for certification of the marine vessel 10 as a RIB. The fender, whether inflatable or foam, may comprise an outer skin comprising a fabric, such as hypalon, polyurethane or polyvinylchloride. Alternatively, the upper body 12 may comprise a deck, gunwale or the like.

The hull 11 comprises a hull bow 25 adjacent to or forming the vessel bow 17 and a hull stern 26 adjacent to or forming the vessel stern 18. The bow section 14 comprises the hull bow 25 and the stern section 15 comprises the hull stern 26. In the illustrated embodiment the hull 11 comprises, ordered outwardly from the centreline 20, a vee bottom section 30, a pair of retainer walls 40, 41, a pair of outer hull sections 50, 51, a pair of outer chines 60, 61 and a pair of hull sides 70, 71. Each of the port and starboard sides 21, 22 may comprise part of the vee bottom section 30, a retainer wall 40, 41, an outer hull section 50, 51, an outer chine 60, 61 and a hull side 70, 71. Each of the vee bottom section 30, retainer walls 40, 41, outer hull sections 50, 51, outer chines 60, 61 and hull sides 70, 71 may extend from the hull stern 26 to the hull bow 25 along the centreline 20 and may comprise substantially flat planar surface(s).

The hull 11 further comprises a stem 80 at the hull bow 25. The stem 80 may be raked and may extend aft downwardly or forwards upwardly. The vee bottom section 30, retainer walls 40, 41, outer hull sections 50, 51, outer chines 60, 61 and hull sides 70, 71 of each of the port and starboard sides 21, 22 may converge towards or into and meet at the stem 80. The stem 80 may be curved as illustrated and the radius of curvature of the stem 80 may be relatively smaller for marine vessels of relatively less length.

Figure 6:
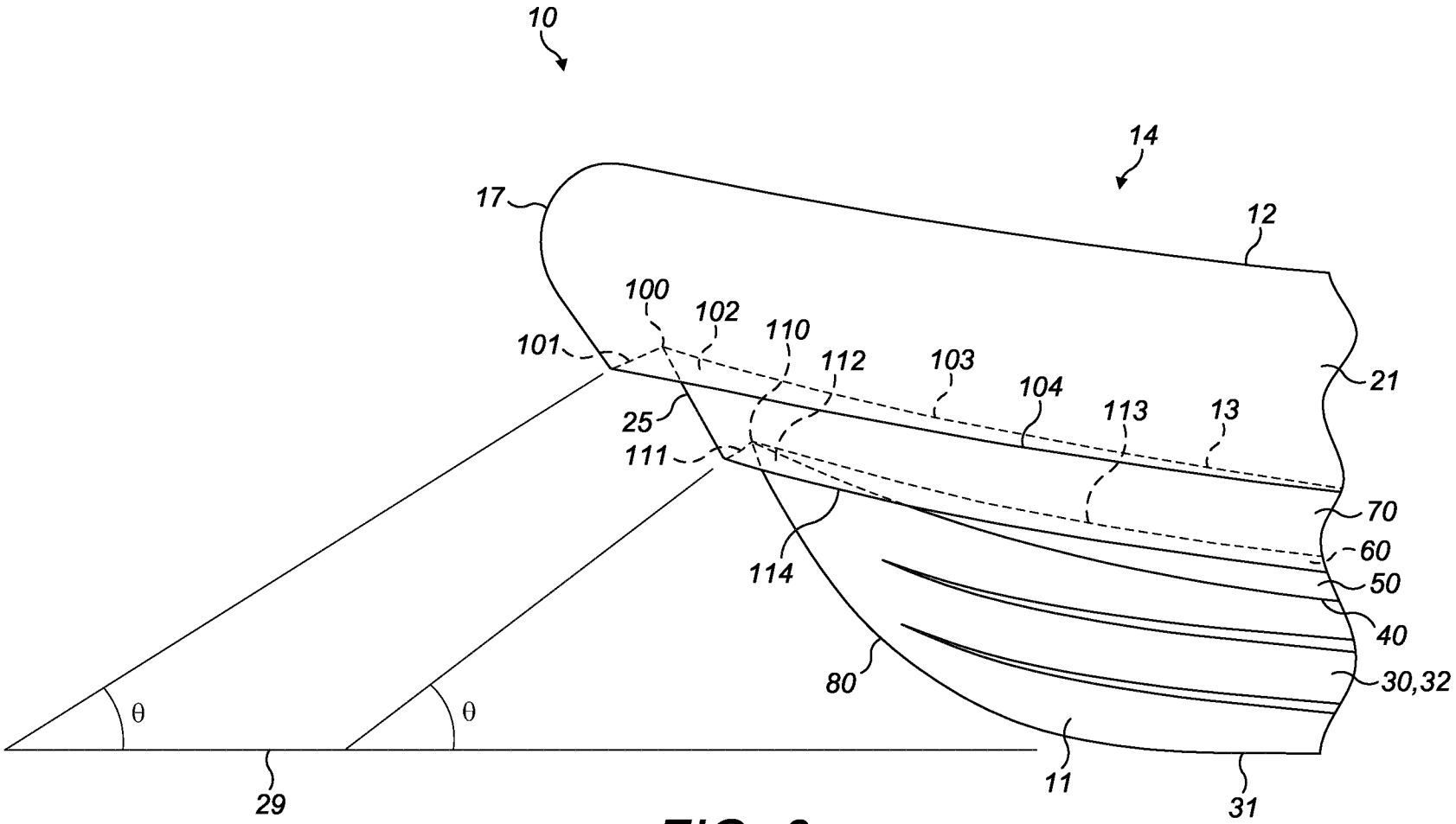
FIG. 6 is a magnified schematic side elevation showing the bow section of the port side of a further embodiment of a marine vessel in accordance with the present disclosure.

The hull 11 further comprises a keel 31 and the keel 31 may extend from the hull stern 26 towards the stem 80. The stem 80 may extend from the hull bow 25 to the keel 31. The keel 31 and/or stem 80 extend along or substantially in the plane of the centreline 20. In the present disclosure the term "keel" refers to the bottom most edge or part of the marine vessel 10. As best shown in FIGS. 1 and 6, the hull 11 may comprise or define a keel line 29 extending along and projected from the keel 31 and/or longitudinally (i.e. from the vessel bow 17 to the vessel stern 18) along the centreline 20.

The hull 11 comprises a vee bottom section 30 extending along the centreline 20 from the stern section 15, particularly the hull stern 26, towards the bow section 14, particularly to the hull bow 25. As illustrated, the vee bottom section 30 may extend entirely from the hull stern 26 to the bow section 14 and particularly to the stem 80. The vee bottom section 30 is V-shaped and forms the keel 31 of the marine vessel 10. The vee bottom section 30 beneficially reduces the impact felt by the crew when the hull 11 re-enters the water after being raised above the water after hitting a large wave. In particular, the vee bottom section 30 re-enters the water more gradually to reduce the impact. In addition, if the hull 11 is leaning to one side the greater surface area on that side provides more lift than the other side, thereby assisting with levelling the hull 11.

Figure 3:
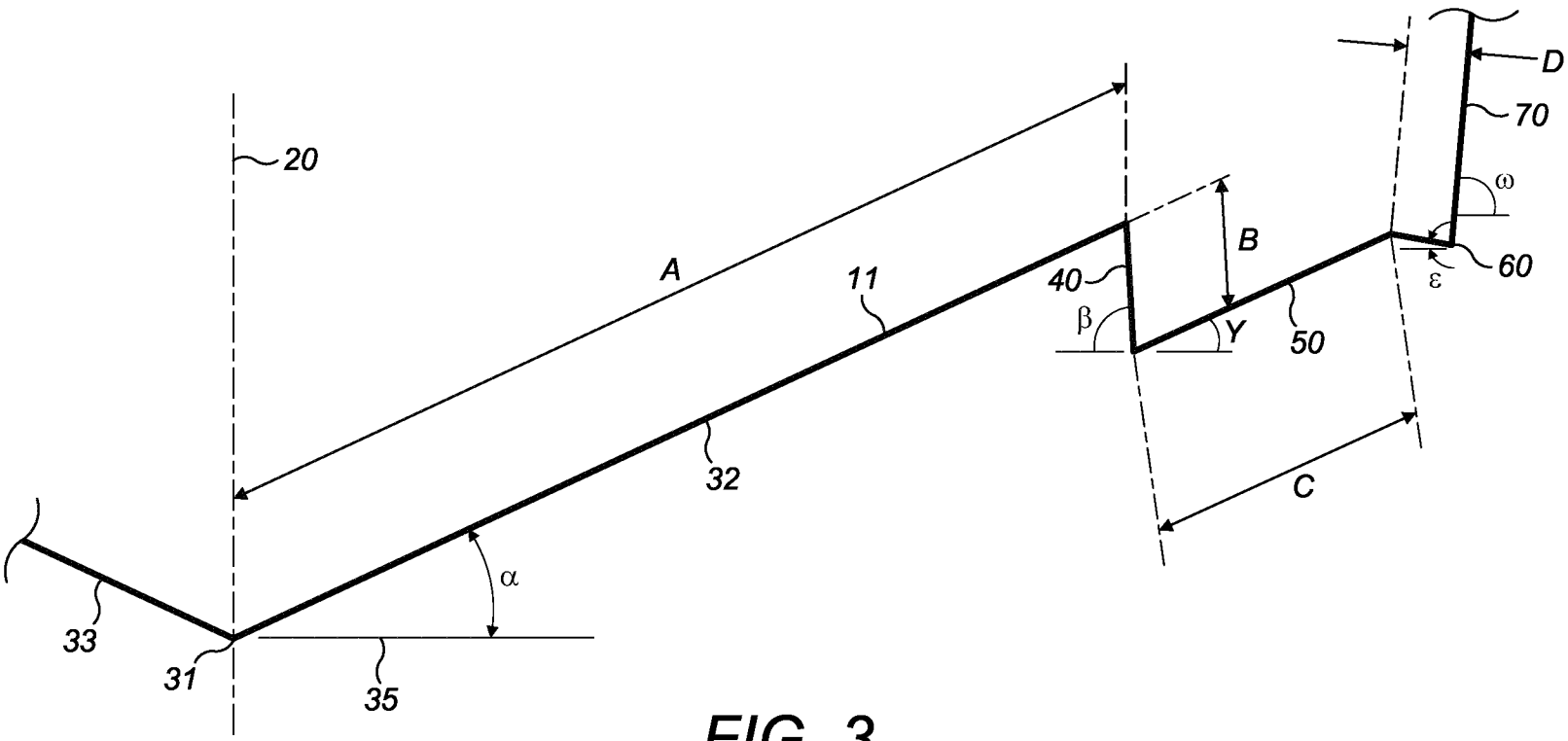
FIG. 3 is a magnified view of a portion of FIG. 2C illustrating the angles and relative dimensions of the hull of the present disclosure.
Figure 4:
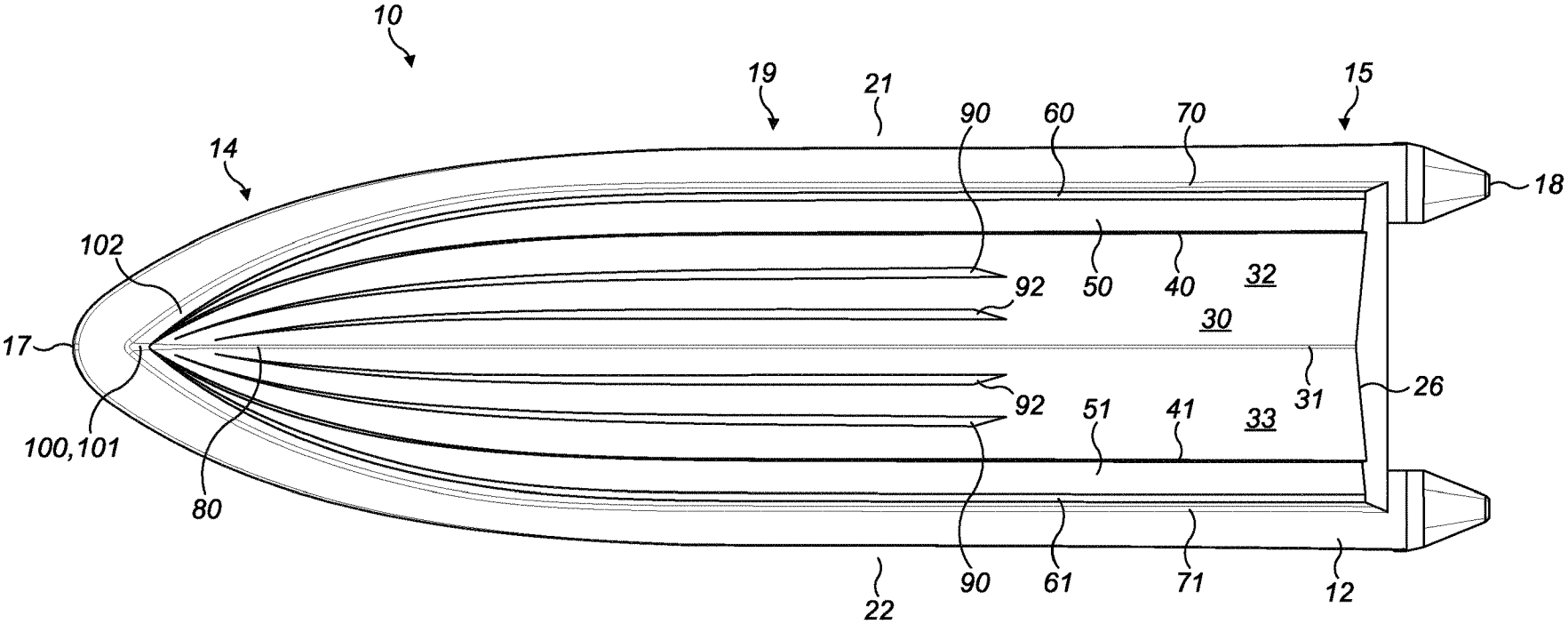
FIG. 4 is a plan view of the underside of the marine vessel of FIGS. 1 to 3.
Figure 5:
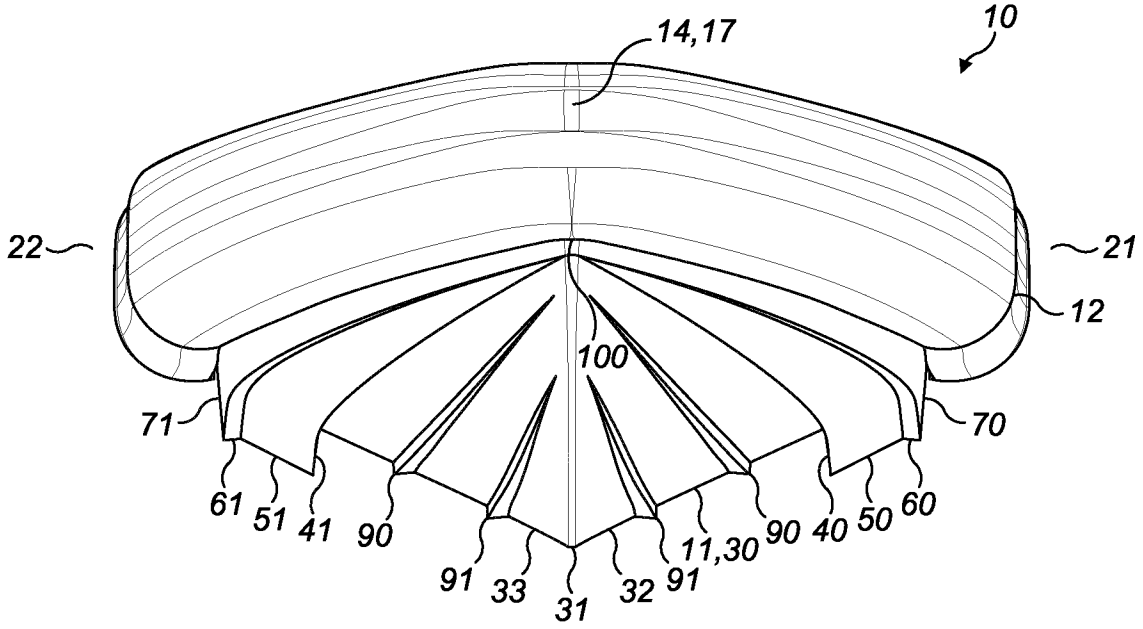
FIG. 5 is a front view of the marine vessel of FIGS. 1 to 4.

The vee bottom section 30 comprises a pair of lower main sections 32, 33 extending outwardly from each side of the centreline 20. The vee bottom section 30 is substantially symmetrical about the centreline 20. The lower main sections 32, 33 may each be a substantially flat planar surface, preferably in at least the stern and/or amidships sections 15, 19, which may extend from the centreline 20 or keel 31 to the respective adjacent retainer wall 40, 41. Each lower main section 32, 33 extends outwardly from the centreline 20 at a vee bottom angle $\alpha$ relative to horizontal. By way of an example, the horizontal is illustrated in FIG. 3 by a horizontal bottom plane 35 orthogonal to the centreline 20. The vee bottom angle $\alpha$ may be at least about 18 degrees, less than about 28 degrees or in the range of from about 18 degrees to about 28 degrees inclusive in the stern section 15.

The keel 31 may be formed by an edge at the intersection between the substantially flat planar surfaces of the lower main sections 32, 33. This may provide the vee bottom section 30 with its v-shape.

The vee bottom section 30 may extend across at least 50% of a beam (i.e. maximum outer width) of the marine vessel 10, particularly in the stern and amidships sections 15, 19. A lower main section width A is the width along each lower main section 32, 33 extending outwardly from the centreline 20. The lower main section width A varies depending upon the size and design of the marine vessel 10.

The vee bottom angle $\alpha$ and lower main section width A varies between the hull stern 26 and hull bow 25. In particular, the vee bottom angle $\alpha$ increases and/or the lower main section width A decreases towards the hull bow 25 and/or from the stern section 15, through the amidships section 19 and into the bow section 14.

The hull 11 may further comprise at least one pair of spray rails 90, 91, 92, 93 at least partially extending along the vee bottom section 30 on either side of the centreline 20. The at least one pair of spray rails 90, 91, 92, 93 may provide lift at the bow section 14 of the marine vessel 10 by directing spray downwardly from the hull 11. Each spray rail 90, 91, 92, 93 is located between the centreline 20 and one of the retainer walls 40, 41 and is elongate in a direction parallel to the centreline 20. As illustrated, the hull 11 may comprise two pairs of spray rails 90, 91, 92, 93 and the spray rails 90, 91, 92, 93 on each of the lower main sections 32, 33 are spaced apart from each other and from the centreline 20 and retainer wall 40, 41.

The spray rails 90, 91, 92, 93 may extend from adjacent the hull bow 25 or stem 80 towards the hull stern 26. The spray rails 90, 91, 92, 93 may not extend into the stern section 15 since this part of the marine vessel 10 rarely leaves the water such that they are not required. For example, the spray rails 90, 91, 92, 93 may extend from within about 10% of the length of the hull 11 from the hull bow 25 or stem 80 and may extend to less than two thirds of the length of the hull 11. In the stern section 15, there may be no steps, spray rails or the like across the vee bottom section 30 between the keel 31 and retainer walls 40, 41 and the vee bottom section 30 may comprise outwardly and upwardly extending substantially flat planar surfaces 32, 33. Each spray rail 90, 91, 92, 93 may extend at a spray rail angle of at least about 10 degrees, less than about 15 degrees or in a range of from about 10 degrees to about 15 degrees inclusive relative to horizontal.

The hull 11 comprises retainer walls 40, 41 extending from the stern section 15 towards the bow section 14 and along and outwardly from either side of the vee bottom section 30 for providing hydrodynamic lift to the marine vessel 10. Each retainer wall 40, 41 extends between the vee bottom section 30 and an outer hull section 50, 51, may comprise a substantially flat planar surface extending from the vee bottom section 30 preferably to the respective outer hull section 50, 51 and may be adjacent to and/or extending from the vee bottom section 30. The retainer walls 40, 41 may extend substantially parallel to each other, the centreline 20 and/or the keel 31 in the stern section 15 and preferably along at least 50% of the amidships section 19 from the stern section 15.

The retainer walls 40, 41 of the port and starboard sides 21, 22 of the hull 11 meet at the hull bow 25. Each of the retainer walls 40, 41 may extend from the hull stern 26 or may be separated from the hull stern 26. For example, the retainer walls 40, 41 may only start in the stern section 15 at a distance from the hull stern 26 and the distance may be at least about 20 cm. The vee bottom section 30 may extend between the hull stern 26 and the retainer walls 40, 41.

Each retainer wall 40, 41 extends downwardly parallel to, or at an acute angle to, the centreline 20 and may extend downwardly at an acute angle to adjacent lower main section 32, 33 of the vee bottom section 30. Thus the retainer wall 40, 41 extends downwardly, preferably directly from the vee bottom section 30, at a retainer wall angle $\beta$ relative to horizontal and the retainer wall angle $\beta$ is less than about 90 degrees, more than about 70 degrees or in the range of from about 70 degrees to about 90 degrees inclusive in the stern section 15. Such ranges are particularly effective at providing sufficient lift to the marine vessel 10 during planing.

The retainer walls 40, 41 do not extend downwardly lower than the keel 31 and the keel 31 is below or lower than the retainer walls 40, 41. A retainer wall height B, which is the dimension of each retainer wall 40, 41 in a direction extending away from the vee bottom section 30, may be sufficiently small such that the keel 31 is below or lower than the retainer walls 40, 41. Thus the retainer wall height B may be defined as $B<A(\sin\alpha/\cos\beta)$. The retainer wall height B may be less than about 0.5 A, may be less than about 0.25

A and/or may be in the range of from about 0.09 A to about 0.22 A inclusive in the stern section 15. When the retainer walls 40, 41 extend to the hull stern 26, the retainer wall height B may be carefully calculated at the hull stern 26 to produce the right amount of lift.

The retainer wall height B may sufficiently large, such as at least about 0.09 A, to prevent any sideways movement of the hull 11 in a tight fast turn and to prevent outward movement of the water spraying from the vee bottom section 30. The retainer wall height B as discussed above may also help ensure that the water generating the hydraulic lift has no air bubbles in it, which can cause propeller cavitation and wear to the surface of the blades.

The retainer wall angle β and retainer wall height B may vary, preferably continuously and/or constantly, between the hull stern 26 and hull bow 25.

In particular, the retainer wall height B may reduce towards the hull bow 25, which may be because towards the hull bow 25 the retainer walls 40, 41 may not provide substantial lift as they are not in the water and instead act as spray rails. The retainer wall height B may continuously increase towards the hull stern 26 in the stern section 15, amidships section 19 and/or bow section 14.

The retainer wall angle β may increase, preferably continuously, towards the hull bow 25 and/or from the stern section 15, preferably through the amidships section 19 and preferably into the bow section 14. Thus the retainer wall angle β may vary in the stern section 15 in a range of from about 70 degrees to about 90 degrees inclusive and may decrease to about or less than about 50 degrees in the bow section 14. The retainer wall angle β may be in the range of about 80 to about 90 degrees at the hull stern 26. The retainer wall angle β may reduce to an angle that will deflect spray downwards to stop it coming over the bow and onto the deck, as discussed below in further detail.

The hull 11 may comprise outer hull sections 50, 51 extending from the stern section 15 towards the bow section 14 and along, adjacent and/or outwardly from the retainer walls 40, 41. Each outer hull section 50, 51 extends between a retainer wall 40, 41 and an outer chine 60, 61 and may comprise a substantially flat planar surface extending from the respective retainer wall 40, 41 preferably to the respective outer chine 60, 61. The outer hull sections 50, 51 may be configured to provide lift to the hull 11 during a turn. In particular, the angle of attack of the outer hull sections 50, 51 may be configured to provide such lift during a turn.

Each outer hull section 50, 51 extends outwardly at an outer hull angle γ relative to horizontal. The outer hull angle γ may be similar to, such as within about 0 degrees to about ±5 degrees of or within about 0 degrees to about ±10 degrees of, the vee bottom angle α across any one cross-section through the breadth of the hull 11 and/or in the stern section 15 and/or amidships section 19.

An outer hull width C, which is the length of each outer hull section 50, 51 in a direction extending outwardly from the centreline 20, vee bottom section 30 and retainer walls 40, 41, may be sufficiently large to provide sufficient lift during turning. The outer hull width C may be less than the lower main section width A and greater than the retainer wall height B. The outer hull width C may be less that about 0.5 A and/or may be in the range of from about 0.2 A to about 0.4 A inclusive. The outer hull angle γ increases and/or the outer hull width C decreases towards the hull bow 25 and/or from the stern section 15, through the amidships section 19 and into the bow section 14. The outer hull width C may decrease to zero at the hull bow 25.

As best shown in FIG. 1, the retainer walls 40, 41 and/or outer hull sections 50, 51, particularly their lowermost edges, rise away from the keel 31 from the hull stern 26. Thus the retainer walls 40, 41 and/or outer hull sections 50, 51, particularly their lowermost edges, have a greater longitudinal angle δ than the keel 31 and/or vee bottom section 30. The longitudinal angle δ is the angle relative to the horizontal plane and the keel line 29. The longitudinal angle of the keel 31 and keel line 29 may be about 0 degrees and the longitudinal angle δ of the retainer walls 40, 41 and/or outer hull sections 50, 51 may be in the range of from about zero degrees to about 10 degrees inclusive in at least the stern section 15, optionally also in the amidships section 19 and/or bow section 14. When a vee shaped hull banks when turning, it causes more drag which will slow the marine vessel down. The increased angle of attack of the outer hull sections 50, 51 provide more lift and less drag, thereby keeping the hull 11 planing. Such an angle of attack is produced by carefully calculating the diminishing height of the retainer walls 40, 41 towards the hull bow 25. This is important as the level ride of the hull 11 without it could cause the hull bow 25 to plunge deeper than ideal when coming of a wave crest and entering a wave trough.

The outer hull sections 50, 51 may also be proportioned relative to the vee bottom section 30 to provide stability at rest, thereby enabling a person to stand at the edge of the hull 11 without undue movement, but not large enough to reduce the effectiveness of the deep vee bottom section 30.

The hull 11 may comprise outer chines 60, 61 extending from the stern section 15 towards the bow section 14 and along and outwardly from the outer hull sections 50, 51. Each outer chine 60, 61 extends between an outer hull section 50, 51 and a hull side 70, 71 and may comprise a substantially flat planar surface extending from the respective outer hull section 50, 51 preferably to the respective hull side 70, 71. The outer chines 60, 61 may assist with throwing wash downwards rather than outwardly from the hull 11, thereby assisting with providing lift.

Each outer chine 60, 61 extends outwardly at an outer chine angle ε relative to the horizontal. The outer chine angle ε may be less than about 15 degrees, more than about 5 degrees or in the range of from about 5 degrees to about 15 degrees. Such angles may be particularly effective at throwing wash downwards rather than outwardly to assist with lift.

An outer chine width D, which is the length of each outer chine 60, 61 in a direction extending outwardly from the centreline 20, vee bottom section 30, retainer walls 40, 41 and outer hull sections 50, 51, may be sufficiently large to provide lift, particularly during turning. The outer chine width D may be less than the lower main section width A, the retainer wall height B and the outer hull width C. The outer hull width C may be less that about 0.2 A, may be less thank about 0.1 A and/or may be in the range of from about 0.03 A to about 0.07 A inclusive. Such sizing may be particularly effective for throwing wash downwards rather than outwardly to assist with lift.

The hull 11 may comprise hull sides 70, 71 extending from the stern section 15 towards the bow section 14 and along and outwardly/upwardly from the outer chines 60, 61. The hull sides 70, 71 may extend from the outer chines 60, 61 to the upper edge 13 of the hull 11 and may comprise a substantially flat planar surface extending from the respective outer chine 60, 61 to the upper edge 13. The hull sides 70, 71 may extend at a hull side angle ω relative to horizontal and the hull side angle ω may be in the range of from about 67 degrees to about 90 degrees inclusive.

Figure 7:
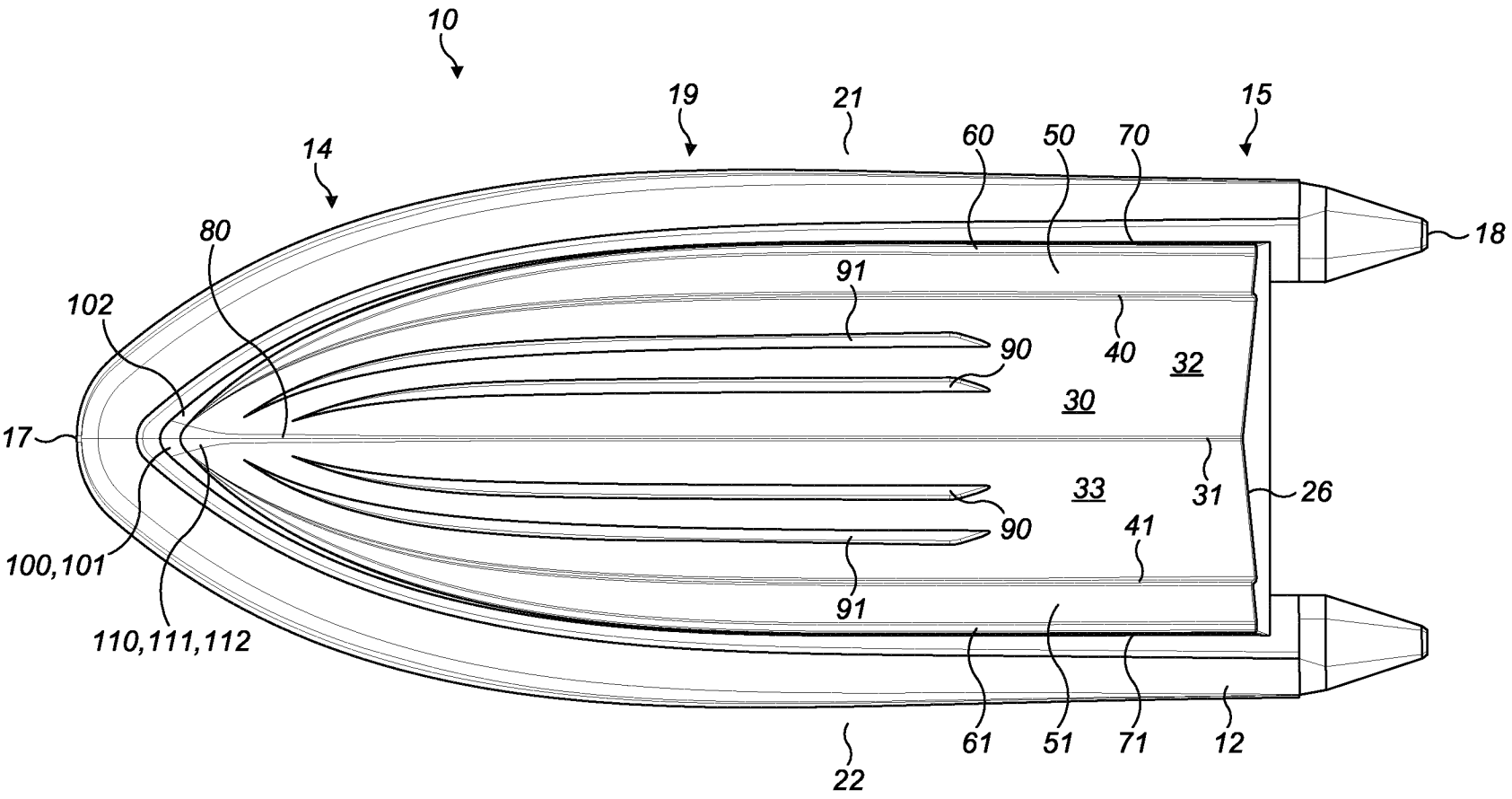
FIG. 7 is a plan view of the underside of the marine vessel of FIG. 6.
Figure 8:
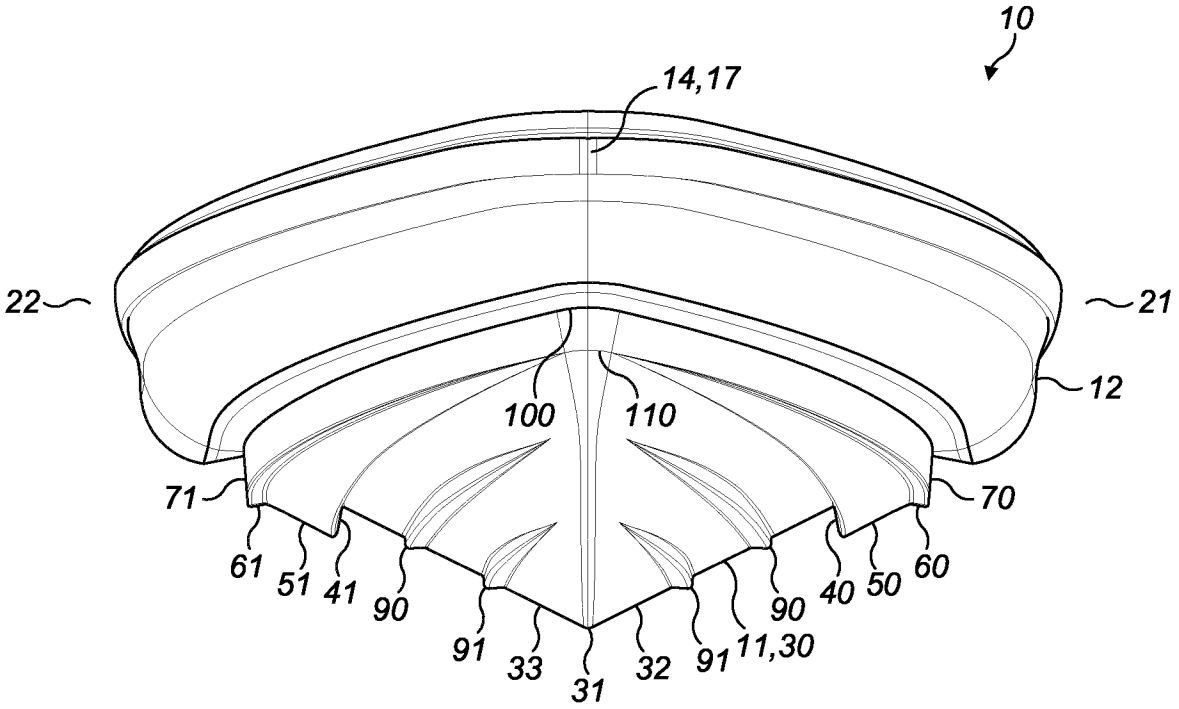
FIG. 8 is a front view of the marine vessel of FIGS. 6 and 7.

The bow section 14 comprises at least one spray deflector 100, 110 for deflecting spray from rising over the bow section 14. FIGS. 1 to 5 illustrate an embodiment of the marine vessel 10 comprising one spray deflector 100 and FIG. 6 to 8 illustrate a further embodiment of the marine vessel 10 comprising two spray deflectors 100, 110. The spray deflectors 100, 110 are best shown in FIG. 6, although the features of the spray deflector 100 of FIG. 6 are substantially the same as the spray deflector 100 of FIGS. 1 to 5.

The at least one spray deflector 100, 110 comprises a deflection surface 101, 111 extending forwards downwardly and outwards downwardly for deflecting spray downwards and/or outwards rather than over the bow section 14. The deflection surface 101, 111 may extend forwards downwardly along the centreline 20 and outwards downwardly away from the centreline 20 on both the port and starboard sides 21, 22. The deflection surface 101, 111 may comprise a substantially flat planar surface.

The deflection surface 101, 111 may be formed by the hull 11 and/or upper body 12. The deflection surface 101, 111 may extend around the hull bow 25 and/or vessel bow 17 and thus may be partially formed in each of the port and starboard sides 21, 22. The deflection surface 101, 111 may extend downwardly forwards from the stem 80, the hull bow 25, the upper body 12 and/or the upper edge 13 of the hull 11. The deflection surface 101, 111 may extend downwardly outwards from the vee bottom section 30, the retainer walls 40, 41, the outer hull sections 50, 51, the outer chines 60, 61 and/or the hull sides 70, 71.

The at least one spray deflector 100 may comprise a deflection cavity 102, 112 formed between the deflection surface 101, 111 and the hull 11 and/or the upper body 12. The deflection cavity 102, 112 is an upwardly extending concave recess as illustrated. The deflection cavity 102, 112 may be substantially V-shaped, such as when the marine vessel is viewed in a bottom plan view as in FIGS. 4 and 7. The deflection cavity 102, 112 may extend around the bow section 14 partially along the port side 21, through the centreline and partially along the starboard side 22. The deflection cavity 102, 112 may extend along a portion of the bow section 14, such as along up to 75% of the length of the bow section 14 or along up to 20% of the length of the marine vessel 10 from the vessel bow 17.

The deflection surface 101, 111 extends from an inner deflection surface edge 103, 113 to an outer deflection surface edge 104, 114. The inner deflection surface edge 103, 113 is higher, above or upwardly from the outer deflection surface edge 104, 114. The deflection cavity 102, 112 may be bounded by the deflection surface 101, 111 and the hull 11, such as the hull sides 70, 71 or the vee bottom section 30.

The deflection surface 101, 111 may extend forwards by a length (i.e. from the hull 11, the stem 80 or the vee bottom section 30) that is greater than the outer chine width D. The deflection surface 101, 111 may extend forwards by a length of at least about 25 mm or at least about 50 mm, which may ensure that the deflection surface 101, 111 is sufficiently large to capture spray. The deflection surface 101, 111 may extend forwards by a length of less than about 200 mm or less than about 150 mm, which may ensure that the bow does not step back too significantly.

The deflection surface 101, 111 may extend forwards downwardly along the centreline 20 at a defection surface angle θ relative to the keel line 29 of the hull 11. The defection surface angle θ may be about 10 degrees, at least about 10 degrees, less than about 10 degrees or in the range of from about 10 degrees to about 30 degrees inclusive. Such a range may be particularly suitable for deflecting spray downwards during planing.

The upper body 12 comprises or at least partially forms the upper body spray deflector 100 of FIGS. 1 to 5 and the upper body spray deflector 100 of FIGS. 6 to 8. The upper body spray deflector 100 extends from the stem 80 at least partially around the upper edge 13 of the hull 11. The upper body 12 comprises the deflection surface 101 extending outwardly and forwards from the top of the stem 80 and upper edge 13 of the hull 11. The deflection cavity 102 is partially bounded by the upper body 12 and thus the upper body 12 comprises an upwardly extending concave recess on its lower side. The inner deflection surface edge 103 is at the upper edge 13 of the hull 11. The outer deflection surface edge 104 is at a lower edge of the upper body 12.

If the upper body 12 comprises a fender then the deflection surface 101 may be moulded as part of the fender (whether foam, inflatable or composite) or may be formed by machining away material if the fender is formed from foam or the like.

The hull 11 comprises the hull spray deflector 110 of FIGS. 6 to 8. The hull 11 comprises the deflection surface 111 located at the stem 80 and the hull 11 comprises the deflection cavity 112, which may in in the form of a concave recess extending upwardly into the stem 80 and/or hull 11. The hull 11 also comprises the inner and outer deflection surface edges 103. The hull spray deflector 110 may be formed during the moulding of the hull 11.

In the illustrated embodiment of the hull spray deflector 110 the outer chines 60, 61 comprise the deflection surface 111. In particular, the outer chines 60, 61 may extend around the hull bow 25 and project forwardly at the stem 80 to form the deflection surface 111. The outer chine width D may be greater than zero around the hull bow 25. The outer chine angle ε may increase to the hull bow 25 and may form the defection surface angle θ at the hull bow 25 in the plane of the centreline. Thus the outer chine angle ε may be at least about 10 degrees, less than about 10 degrees or in the range of from about 10 degrees to about 30 degrees inclusive at the hull bow 25. Preferably the outer chine angle ε is in the range from about 20 degrees to about 30 degrees inclusive at the hull bow 25. Therefore, the outer chines 60, 61 may be configured to effectively direct spray downwards. In addition, the retainer wall height B and outer hull width C may reduce to zero at the hull bow 25 as illustrated in FIG. 6.

The deflection cavity 112 may be bounded by the outer chines 60, 61 forming the deflection surface 111, the vee bottom section 30 (particularly adjacent to the hull bow 25) and the outer hull sections 50, 51. The inner deflection surface edge 113 is along the meeting line of the outer hull sections 50, 51 and the outer chines 60, 61. The outer deflection surface edge 114 is along the meeting line of the outer hull sections 50, 51 and the hull sides 70, 71.

The upper and hull body spray deflectors 100, 110 may have different dimensions and the upper spray deflector 100 may be generally larger, by for example having a larger deflection cavity 102, than the hull body spray deflector 110. The upper body spray deflector 100 may extend forwards by a greater distance than the hull body spray deflector 110.

Including both the upper and hull body spray deflectors 100, 110 is particularly beneficial in smaller marine vessels 10, which are relatively closer to the water (i.e. the upper edge 13 is relatively closer to the water). The presence of both spray deflectors 100, 110 therefore assists with deflecting the relatively increased amount of spray.

Various alternative embodiments fall within the scope of the present disclosure. The marine vessel 10 may comprise a hull spray deflector 110 formed according to FIGS. 6 to 8 without the upper body spray deflector 100. A hull spray deflector 110 may be formed in the hull 11 by the retainer walls 40, 41 comprising the deflection surface 111 in a similar manner to the outer chines 60, 61 forming the deflection surface 111 in FIGS. 6 to 8.

The invention claimed is:

1. A marine vessel comprising:

a bow section, a stern section and a centreline; and a planing hull extending between a hull bow in the bow section and a hull stern in the stern section, the planing hull comprising:

a vee bottom section extending along the centreline from the stern section to the bow section, the vee bottom section being V-shaped and forming a keel of the marine vessel; and a pair of retainer walls extending from the stern section towards the bow section along either side of the vee bottom section, wherein, in at least the stern section each retainer wall extends downwardly parallel to, or at an acute angle to, the centreline and lowermost edges of the retainer walls rise away from the keel from the hull stern by the lowermost edges having a greater longitudinal angle than the keel, the longitudinal angle being the angle relative to the horizontal plane and a keel line, the keel line extending along and projected from the keel, and wherein the vee bottom section is configured to, as the marine vessel travels across water, direct water outwardly from the centreline towards the retainer walls and the retainer walls are configured to direct said outwardly directed water aft relative to the hull and retain said aft directed water between the retainer walls and vee bottom section in at least the stern section for providing lift to the marine vessel.

2. The marine vessel as claimed in claim 1, wherein the retainer walls extend parallel to the centreline and/or keel in the stern section.

3. The marine vessel as claimed in claim 1, wherein the retainer walls are configured to, towards the hull stern, increase a ratio of water to air per unit of volume between the retainer walls and the vee bottom section.

4. The marine vessel as claimed in claim 1, wherein the keel is lower than the retainer walls.

5. The marine vessel as claimed in claim 1, wherein the vee bottom section comprises a pair of lower main sections each extending outwardly from each side of the centreline along a lower main section width A, the retainer walls extend along a retainer wall height B and the retainer wall height B is less than about 0.5 A.

6. The marine vessel as claimed in claim 1, wherein the vee bottom section extends outwardly from the centreline at a vee bottom angle $\alpha$ relative to horizontal, which is in a range of from about 18 degrees to about 28 degrees inclusive, and/or the retainer walls extend downwardly at a retainer wall angle $\beta$ relative to horizontal, which is in a range of from about 70 degrees to about 90 degrees inclusive.

7. The marine vessel as claimed in claim 1, wherein the retainer walls extend from the hull stern.

8. A marine vessel comprising:

a bow section, a stern section and a centreline; and a planing hull extending between a hull bow in the bow section and a hull stern in the stern section, the planing hull comprising:

a vee bottom section extending along the centreline from the stern section to the bow section, the vee bottom section being V-shaped and forming a keel of the marine vessel; and a pair of retainer walls extending from the stern section towards the bow section along either side of the vee bottom section, and wherein the bow section comprises at least one spray deflector for deflecting spray from rising over the bow section, the at least one spray deflector comprising a deflection surface extending downwardly forwards along the centreline and outwards from the centreline.

9. The marine vessel as claimed in claim 8, further comprising an upper body mounted to the hull, optionally wherein the upper body comprises a fender, deck or gunwale.

10. The marine vessel as claimed in claim 8, wherein the keel extends along a keel line and the deflection surface extends downwardly forwards along the centreline at a deflection surface angle relative to the keel line in a range of from 10 degrees to 30 degrees inclusive.

11. The marine vessel as claimed in claim 9, wherein the at least one spray deflector comprises an upper body spray deflector comprising a deflection surface formed by the upper body and a deflection cavity formed between the deflection surface and the hull.

12. The marine vessel as claimed in claim 11, wherein the deflection cavity of the upper body spray deflector is partially bounded by the upper body and is formed by an upwardly extending concave recess in the upper body.

13. The marine vessel as claimed in claim 11, wherein the hull comprises a stem and an upper edge to which the upper body is mounted, wherein the upper body spray deflector extends from the stem at least partially around the upper edge of the hull.

14. The marine vessel as claimed in claim 8, further comprising outer hull sections extending from the stern section towards the bow section and along and outwardly from the retainer walls.

15. The marine vessel as claimed in claim 14, further comprising outer chines extending from the stern section towards the bow section and along and outwardly from the outer hull sections.

16. The marine vessel as claimed in claim 8, wherein the at least one spray deflector comprises a hull spray deflector comprising a deflection surface formed by the hull and a deflection cavity formed between the deflection surface and the hull.

17. The marine vessel as claimed in claim 16, wherein the hull comprises a stem and the deflection surface is located at the stem, wherein the hull comprises the deflection cavity in the form of a concave recess extending upwardly into the stem and hull.

18. A method of operating a marine vessel comprising:

a bow section, a stern section and a centreline; and a planing hull extending between a hull bow in the bow section and a hull stern in the stern section, the planing hull comprising:

a vee bottom section extending along the centreline from the stern section to the bow section, the vee bottom section being V-shaped and forming a keel of the marine vessel; and a pair of retainer walls extending from the stern section towards the bow section along either side of the vee bottom section, wherein, in at least the stern section each retainer wall extends downwardly parallel to, or at an acute angle to, the centreline, and lowermost edges of the retainer walls rise away from the keel from the hull stern by the lowermost edges having a greater longitudinal angle than the keel, the longitudinal angle being the angle relative to the horizontal plane and a keel line, the keel line extending along and projected from the keel, and wherein the method comprises propelling the marine vessel through water such that the vee bottom section directs water outwardly from the centreline towards the retainer walls and the retainer walls direct said outwardly directed water aft relative to the hull and retain said aft directed water between the retainer walls and vee bottom section in at least the stern section such that lift is provided to the marine vessel.

19. The method as claimed in claim 18, wherein the bow section comprises at least one spray deflector, the at least one spray deflector comprising a deflection surface extending downwardly forwards along the centreline and outwards from the centreline, wherein the method comprises propelling the marine vessel through the water such that the at least one spray deflector deflects spray from rising over the bow section.

20. A marine vessel comprising:

a bow section, a stern section and a centreline; and a planing hull extending between a hull bow in the bow section and a hull stern in the stern section, the planing hull comprising:

a vee bottom section extending along the centreline from the stern section to the bow section, the vee bottom section being V-shaped and forming a keel of the marine vessel; and a pair of retainer walls extending from the stern section towards the bow section along either side of the vee bottom section, wherein, in at least the stern section each retainer wall extends downwardly parallel to, or at an acute angle to, the centreline and the retainer walls rise away from the keel from the hull stern, and wherein the vee bottom section is configured to, as the marine vessel travels across water, direct water outwardly from the centreline towards the retainer walls and the retainer walls are configured to direct said outwardly directed water aft relative to the hull and retain said aft directed water between the retainer walls and vee bottom section in at least the stern section for providing lift to the marine vessel, wherein the retainer walls are separated from the hull stern.

21. A marine vessel comprising:

a bow section, a stern section and a centreline; and a planing hull extending between a hull bow in the bow section and a hull stern in the stern section, the planing hull comprising:

a vee bottom section extending along the centreline from the stern section to the bow section, the vee bottom section being V-shaped and forming a keel of the marine vessel; and a pair of retainer walls extending from the stern section towards the bow section along either side of the vee bottom section, wherein, in at least the stern section each retainer wall extends downwardly parallel to, or at an acute angle to, the centreline and the retainer walls rise away from the keel from the hull stern, wherein the vee bottom section is configured to, as the marine vessel travels across water, direct water outwardly from the centreline towards the retainer walls and the retainer walls are configured to direct said outwardly directed water aft relative to the hull and retain said aft directed water between the retainer walls and vee bottom section in at least the stern section for providing lift to the marine vessel, and wherein the retainer walls extend downwardly at a retainer wall angle $\beta$ relative to horizontal, which is about 90 degrees.

* * * * *